US009417580B2

(12) United States Patent
Suwabe

(10) Patent No.: US 9,417,580 B2
(45) Date of Patent: Aug. 16, 2016

(54) IMAGE FORMING APPARATUS, CONTROL METHOD THEREOF, AND STORAGE MEDIUM

(71) Applicant: CANON KABUSHIKI KAISHA, Tokyo (JP)

(72) Inventor: Takeshi Suwabe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/566,631

(22) Filed: Dec. 10, 2014

(65) Prior Publication Data

US 2015/0168899 A1 Jun. 18, 2015

(30) Foreign Application Priority Data

Dec. 17, 2013 (JP) ..... 2013-259998

(51) Int. Cl.
*G03G 15/00* (2006.01)

(52) U.S. Cl.
CPC ..... *G03G 15/5016* (2013.01); *G03G 15/5004* (2013.01); *G03G 15/80* (2013.01)

(58) Field of Classification Search
CPC ..... G03G 15/80; G03G 15/5016
See application file for complete search history.

(56) References Cited

FOREIGN PATENT DOCUMENTS

JP 2002-300329 A 10/2002
JP 2002361990 A * 12/2002

OTHER PUBLICATIONS

JP 2002361990 A English Translation, Kamata, Dec. 2002.*

* cited by examiner

*Primary Examiner* — Ryan Walsh
(74) *Attorney, Agent, or Firm* — Canon U.S.A., Inc. IP Division

(57) ABSTRACT

An image forming apparatus which has a plurality of units, power supply to each of the plurality of units being independently controllable, supplies power to each of the plurality of units when each of the plurality of units is used, the image forming apparatus comprising, a storage unit, being nonvolatile, configured to store, when a maintenance required state occurs, a maintenance required factor of the maintenance required state, a shifting unit configured to shift the image forming apparatus in the maintenance required state to a power saving state, a power supply unit configured to supply, when the image forming apparatus recovers from the power saving state, power to a unit corresponding to the maintenance required factor, an acquisition unit configured to acquire information about the maintenance required factor from the unit supplied with power, and a display unit configured to display a maintenance screen based on the information.

25 Claims, 5 Drawing Sheets

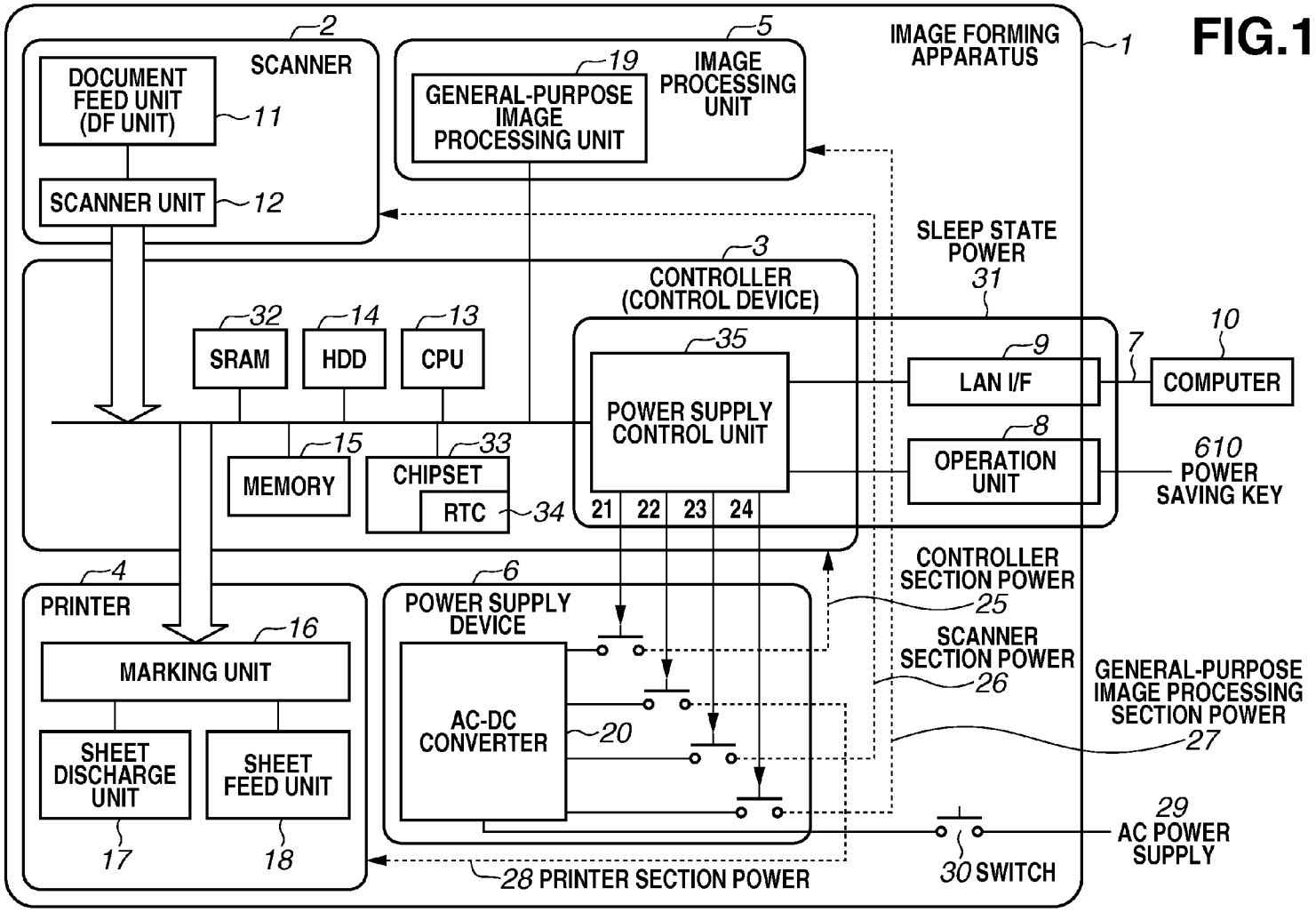
FIG.1
IMAGE FORMING APPARATUS
1
COMPUTER
10
7
610 POWER SAVING KEY
GENERAL-PURPOSE IMAGE PROCESSING SECTION POWER
27
29 AC POWER SUPPLY
SLEEP STATE POWER
31
LAN I/F
9
OPERATION UNIT
8
CONTROLLER SECTION POWER
25
SCANNER SECTION POWER
26
30 SWITCH
IMAGE PROCESSING UNIT
5
GENERAL-PURPOSE IMAGE PROCESSING UNIT
19
CONTROLLER (CONTROL DEVICE)
3
POWER SUPPLY CONTROL UNIT
35
24
23
22
21
20
POWER SUPPLY DEVICE
6
AC-DC CONVERTER
28 PRINTER SECTION POWER
CPU
13
HDD
14
SRAM
32
CHIPSET
33
RTC
34
MEMORY
15
SCANNER
2
DOCUMENT FEED UNIT (DF UNIT)
11
SCANNER UNIT
12
PRINTER
4
MARKING UNIT
16
SHEET FEED UNIT
18
SHEET DISCHARGE UNIT
17

IMAGE FORMING APPARATUS, CONTROL METHOD THEREOF, AND STORAGE MEDIUM

BACKGROUND

1. Field

Aspects of the present invention generally relate to an image forming apparatus, a control method thereof, and a storage medium.

2. Description of the Related Art

Recently, an image forming apparatus maintaining power saving has a configuration in which power is not supplied to an engine, such as a printer and/or a scanner, while being in a sleep state. With this configuration, when performing a job, the image forming apparatus only activates an engine required for performing the job.

In addition, when a sheet jam occurs or consumables, such as sheets or toner, run out, in order to recover from such a state, a conventional image forming apparatus displays a maintenance screen on an operation unit. Information required for displaying the maintenance screen is often acquired from an engine, such as a printer and/or a scanner.

Japanese Patent Application Laid-Open No. 2002-300329 discusses a technique for turning off power source of a power source system by determining whether an image forming apparatus having a low power mode as a system is allowed to shift to the low power mode at a low power mode shifting time, and for performing sleep and recovery processing using a real-time clock (RTC). According to the technique discussed in Japanese Patent Application Laid-Open No. 2002-300329, in a case where an error is detected when shifting to the low power mode, the image forming apparatus shifts to the sleep mode after resolving the error. The error is referred to any state requiring maintenance, such as a sheet jam.

However, if the above conventional image forming apparatus shifts to the sleep mode with a sheet jam or without consumables, such as sheets or toner, since no power is supplied to an engine when the image forming apparatus is activated next time, a user notices the error, such as the sheet jam or the absence of the consumables only after the user actually causes the image forming apparatus to perform a job. Thus, not only the usability is deteriorated but also necessary maintenance is delayed.

In addition, according to the technique discussed in Japanese Patent Application Laid-Open No. 2002-300329, since the image forming apparatus shifts to the low power mode after resolving the error, power saving of when the error occurs is far from realized in the first place. As described above, no conventional techniques can achieve power saving without deteriorating the usability and the maintainability.

SUMMARY

Aspects of the present invention are generally directed to a configuration that can achieve power saving without deteriorating usability and maintainability of an image forming apparatus.

According to an aspect of the present invention, an image forming apparatus which has a plurality of units, power supply to each of the plurality of units being independently controllable, supplies power to each of the plurality of units when each of the plurality of units is used, the image forming apparatus comprising, a storage unit, being nonvolatile, configured to store, when a maintenance required state occurs, a maintenance required factor of the maintenance required state, a shifting unit configured to shift the image forming apparatus in the maintenance required state to a power saving state, a power supply unit configured to supply, when the image forming apparatus recovers from the power saving state, power to a unit corresponding to the maintenance required factor stored in the storage unit, an acquisition unit configured to acquire information about the maintenance required factor from the unit supplied with power by the power supply unit, and a display unit configured to display a maintenance screen based on the information acquired by the acquisition unit.

Further features of the present disclosure will become apparent from the following description of exemplary embodiments with reference to the attached drawings.

BRIEF DESCRIPTION OF THE DRAWINGS

FIG. 1 is a block diagram illustrating a configuration of an image forming apparatus according to an exemplary embodiment.

DESCRIPTION OF THE EMBODIMENTS

Figure 2:
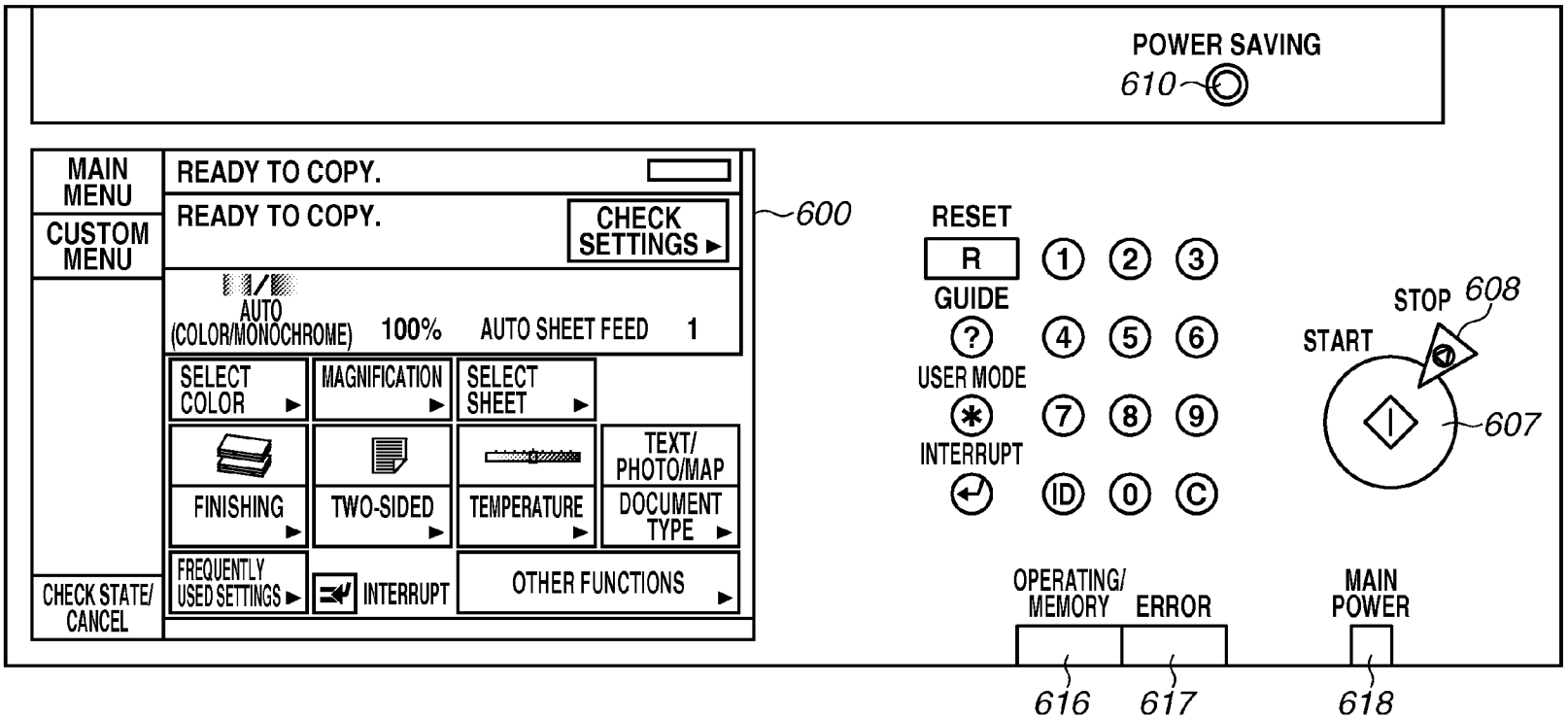
FIG. 2 is a diagram illustrating an example configuration of an operation unit of the image forming apparatus.

Various exemplary embodiments, features, and aspects will be described in detail below with reference to the drawings.

FIG. 1 is a block diagram illustrating an example configuration of an image forming apparatus 1 according to an exemplary embodiment. The image forming apparatus 1 includes a scanner 2, a printer 4, an image processing unit 5, a power supply device 6, an operation unit 8, a local area network (LAN) interface (I/F) 9, and a controller 3.

The scanner 2 is a scanner unit, which is an engine that optically reads an image from a document and converts the image into a digital image. The scanner 2 includes a document feed (DF) unit 11 capable of automatically and sequentially switching a stack of documents and a scanner unit 12 capable of optically scanning a document and converting the scanned document into a digital image. The scanner 2 transmits the converted image data to the controller 3.

The printer 4 is a printer unit, which is an engine that outputs a digital image to a recording medium such as paper. The printer 4 includes a sheet feed unit 18 capable of sequentially feeding sheets one by one from a stack of sheets, a marking unit 16 for printing image data on the fed sheet, and a sheet discharge unit 17 for discharging the printed sheet.

The image processing unit 5 performs processing, such as reduction processing, on image data. The image processing unit 5 includes a general-purpose image processing unit 19 for performing image processing on image data.

The power supply device 6 is a device that supplies power in the image forming apparatus 1. The operation unit 8 is a user interface for operations and displaying for the image forming apparatus 1. The LAN I/F is for connecting the image forming apparatus 1 to a network.

The controller 3 is connected to the scanner 2, the printer 4, the image processing unit 5, the power supply device 6, the operation unit 8, and the LAN I/F 9. By issuing instructions to each of the modules, the controller 3 controls the entire image forming apparatus 1 and executes a job on the image forming apparatus 1. The controller 3 includes a central processing unit (CPU) 13, a hard disk drive (HDD) 14, a memory 15, a static random access memory (SRAM) 32, and a chipset 33.

By reading and executing a computer-readable program recorded in the HDD 14, the CPU 13 realizes various control operations described below. The CPU 13 transmits/receives image data to/from the scanner 2 and the printer 4 and stores the image data. More specifically, the CPU 13 temporality stores image data received from the scanner 2 in the memory 15 and then stores the image data in the HDD 14, so that scanning and storing of an image is completed. Further, the CUP 13 temporarily stores image data read from the HDD 14 in the memory 15 and transmits the image data from the memory 15 to the printer 4, so that print output can be performed. Furthermore, the CPU 13 can causes the general-purpose image processing unit 19 to, for example, reduce image data stored in the memory 15 and can store the reduced image data in the memory 15 again.

The memory 15 includes a read-only memory (ROM) and a random access memory (RAM) that are not illustrated. The ROM stores a program and the like of the CPU 13. The RAM is used as a work area of the CPU 13. The HDD 14 stores digital images, control programs and the like. The SRAM 32 is a nonvolatile memory that stores various setting values of the image forming apparatus 1.

The CPU 13 interprets an operation input by an operator via the operation unit 8. In addition, the CPU 13 displays a job state and a state of an engine, such as the scanner 2 and/or the printer 4, on a liquid crystal display (LCD) touch panel 600 (illustrated in FIG. 2) of the operation unit 8. In addition, the CPU 13 can input/output a digital image from a computer 10 via the LAN I/F 9 through a network 7. The CPU 13 can also receive an instruction for issuance of job and an instruction of a device, and can perform processing therefore. In such a way, the CPU 13 can interpret instructions from the operation unit 8 and the LAN I/F 9 and perform various jobs.

The power supply device 6 is a device that supplies power in the image forming apparatus 1. When the power of the image forming apparatus 1 is off, an alternating-current (AC) power supply 29 is insulated by a switch 30. When the switch 30 is turned on, AC power is supplied to an AC-direct current (DC) converter 20, and DC power is then generated. The power supply device 6 can independently supply power to the scanner 2, the controller 3, the printer 4, and the image processing unit 5.

The chipset 33 is a plurality of a series of related integrated circuits. The chipset 33 includes a real-time clock (RTC) 34, which is a dedicated chip for measuring time. Since the RTC 34 receives power supply from an internal battery (not illustrated), the RTC 34 can operate even when no power is supplied to the controller 3 (for example, even when in the sleep state described below). As long as power is supplied to the chipset 33 in such a way, the image forming apparatus 1 can recover from the sleep state. In contrast, when the image forming apparatus 1 is in a shutdown state in which no power is supplied to the chipset 33, the RTC 34 cannot operate.

The image forming apparatus 1 is sectioned into four sections through the power supply control unit 35, and the power supply device 6 can independently control power supply for the four sections. More specifically, the power supply control unit 35 can control on/off of power supply for controller section power 25 using a switch unit 21. Similarly, the power supply control unit 35 can control on/off of power supply for printer section power 28, scanner section power 26, and general-purpose image processing section power 27 using switch units 22, 23, and 24, respectively. By using these switch units 21 to 24, the power supply control unit 35 appropriately supplies power to a necessary section in the image forming apparatus 1. The power supply control unit 35 is configured by a complex programmable logic device (CPLD), for example.

Various power states of the image forming apparatus 1 will be described.

Sleep State

The sleep state is a state in which the image forming apparatus 1 achieves power saving (power saving state). More power can be saved in the sleep state than in the standby state described below.

Peripheral devices of the CPU 13 are set in a general suspended state (ACPI-S3, for example), and the power supply control unit 35 and only a unit (a sleep state power 31) that can detect a job are supplied with power. In such a way, the apparatus as a whole can be set in a very-low power state. More specifically, the CPU 13 stores a state of the image forming apparatus 1 in the memory 15 and instructs the power supply control unit 35 to turn off the controller section power 25, which includes the CPU 13 itself, using the switch unit 21. While the CPU 13 stops operating in the sleep state, since the sleep state power 31 is turned on by the power supply control unit 35, the operation unit 8 or the LAN I/F 9 can detect a sleep recovery factor. The sleep state power 31 is not necessarily supplied to entire of the operation unit 8 and the LAN I/F 9. Alternatively, supply of the sleep state power 31 may be performed, so that the image forming apparatus 1 can detect a sleep recovery factor. For example, when a reception through the network 7 via the LAN I/F 9 or an operation on the operation unit 8 (for example, pressing of a power saving key 610) is performed, the power supply control unit 35 turns on the controller section power 25. Then, the CPU 13 and the like wake up. The CPU 13 reads the state of the image forming apparatus 1 stored in the memory 15 from the memory 15, performs resetting, and causes the image forming apparatus 1 to recover to the state immediately before the controller section power 25 is turned off. Then, the image forming apparatus 1 shifts to the standby state. The image forming apparatus 1 receives a job after shifting to the standby state. The RTC 34 continuously measures time even in the sleep state. Thus, if a recovery time is set before the image forming apparatus 1 shifts to the sleep state, at the recovery time the RTC 34 can wake the power supply control unit 35 to perform a sleep recovery operation and to wake the CPU 13.

Standby State

The standby state is a state in which the controller section power 25 is supplied with power. In the standby state, the image forming apparatus 1 receives an operation from an operator via the operation unit 8 or a job through the network 7 via the LAN I/F 9, for example. In the standby state, when not necessary, the printer section power 28, the scanner section power 26, and the general-purpose image processing section power 27 are off. Thus, as needed, the CPU 13 instructs the power supply control unit 35 to supply power to a device using a corresponding one of the switch units 22 to 24, and a predetermined job is then executed. For example, depending on a job type, the power supply control unit 35 turns on power supply for each device necessary for the job, as described below. More specifically, in the standby state, the CPU 13 controls power supply for each device so that power is supplied to each device to be used and no power is supplied to the other devices not to be used.

[Copy Function]

The scanner section power 26 and the printer section power 28 are turned on to activate the scanner 2 and the printer 4 to realize a copy function.

[Image Storage Function]

Only the scanner section power 26 is turned on, and the scanner 2 and the HDD 14 are activated to store read image data.

[Print Function]

Only the printer section power 28 is turned on to activate the printer 4 to print various image data.

After a job is completed, the power supplied to the operated device is turned off using the corresponding switch units 22 to 24. In such a way, power can be supplied only to the necessary device when necessary. Thus, the power consumed in the standby state can be reduced.

FIG. 2 is a diagram illustrating a configuration example of the operation unit 8.

The LCD touch panel 600 illustrated in FIG. 2 displays settings for executing a job, a job state, and engine states, for example. Further, the user can perform various operations by touching various buttons and the like displayed on the LCD touch panel 600. A start key 607 is for starting a copy operation. A stop key 608 is for stopping a currently executed copy job. When the power saving key 610 is pressed, the image forming apparatus 1 shifts to the sleep state. When the power saving key 610 is pressed again, the image forming apparatus 1 recovers from the sleep state. A light-emitting diode (LED) 616 indicates that a job is currently executed or an image is being stored in an image memory. An error LED 617 indicates that the image forming apparatus 1 is in a maintenance required state where a jam occurs or a door opens, for example. A power supply LED 618 indicates that the image forming apparatus 1 is in the standby state.

Figure 3:
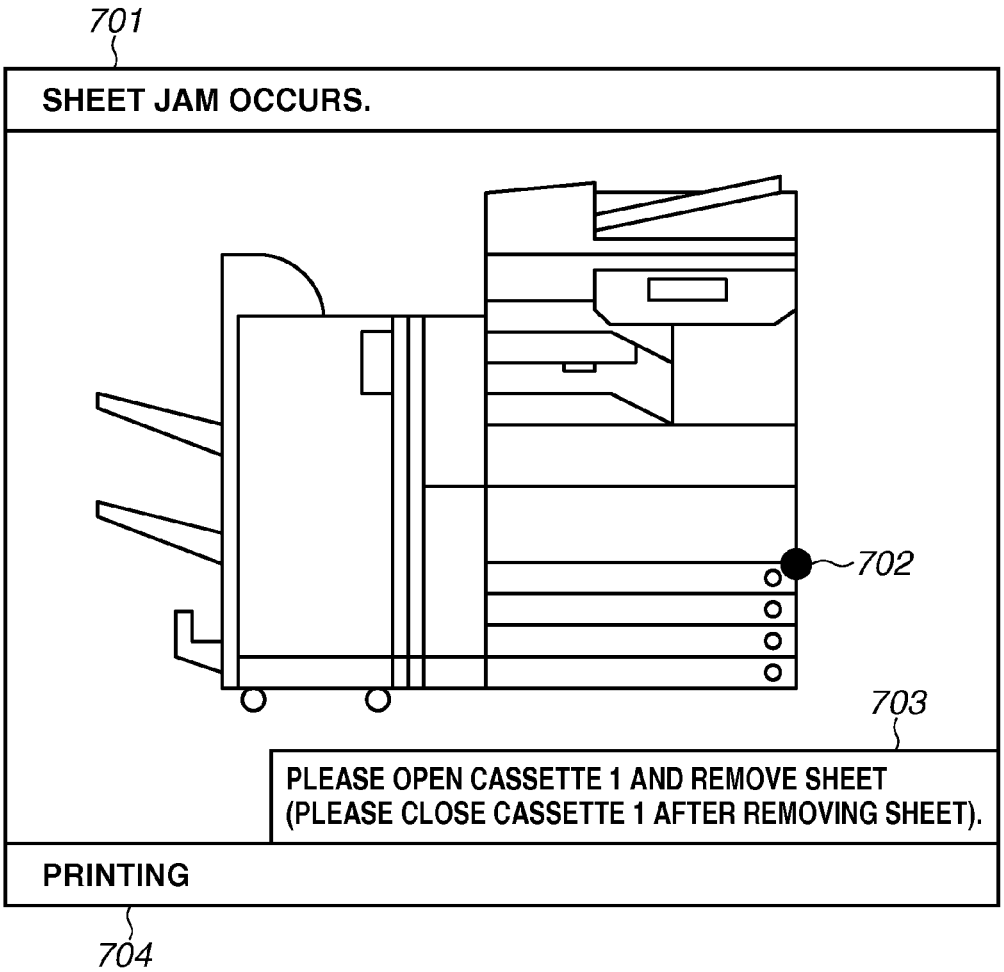
FIG. 3 is a diagram illustrating an example maintenance screen displayed on the operation unit of the image forming apparatus.

FIG. 3 is a diagram illustrating a maintenance screen example displayed by the operation unit 8 when a maintenance required state, such as a sheet jam, occurs.

According to the example illustrated in FIG. 3, a field 701 displays that a sheet jam has occurred. A point 702 is for visually easily notifying the user of where the sheet jam has occurred. A field 703 displays a message for requesting the user to respond to the sheet jam. A field 704 displays a job state.

Figure 4:
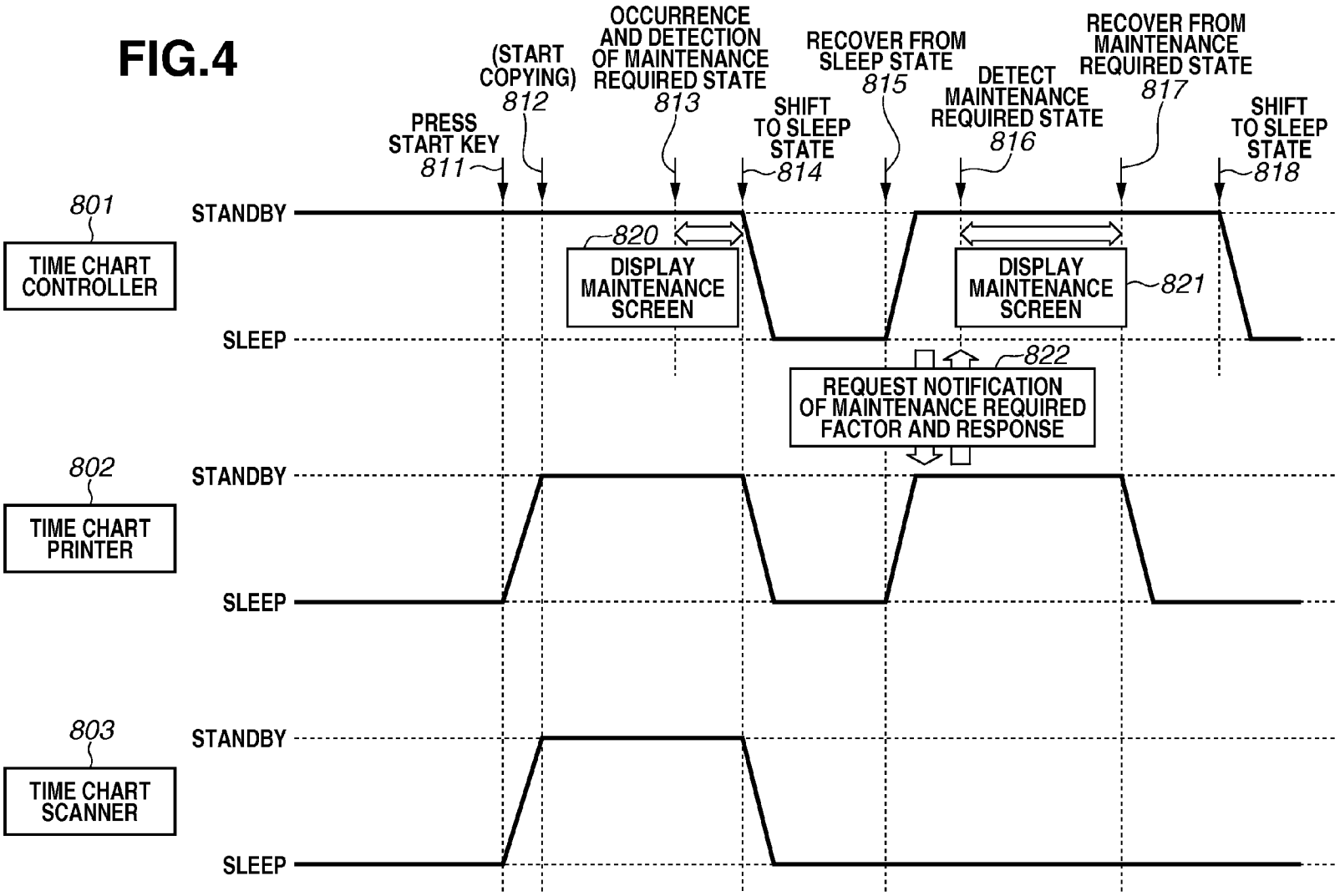
FIG. 4 is a diagram illustrating an example of time charts of the image forming apparatus.

FIG. 4 is a diagram illustrating an example of time charts 801, 802, and 803 of the image forming apparatus 1. The power states illustrated in the time charts 801 to 803 are realized when the CPU 13 gives instructions to the power supply control unit 35.

According to FIG. 4, the time charts 801 to 803 represent the power states of the controller 3, the printer 4, and the scanner 2, respectively. In each of the time chart 801 to 803, the standby state and the sleep state are indicated. The initial state in each of the time charts 801 to 803 is a power-on state. The controller 3 is in the standby state, and the printer 4 and the scanner 2 are in the sleep state.

At a timing 811, a user presses the start key 607 on the copy screen as illustrated in FIG. 2. The CPU 13 turns on the scanner section power 26 and the printer section power 28 to activate the scanner 2 and the printer 4, respectively. At a timing 812, the image forming apparatus 1 starts a copy operation. At the timing 812, the scanner 2 and the printer 4 are in the standby state.

A timing 813 indicates a timing in which a maintenance required state, such as a sheet jam, occurs and is detected. In the case of the printer 4, examples of the maintenance required state other than a sheet jam include absence of consumables, such as sheets, print agent, for example, toner or ink, or staples, and opening of a door. In the case of the scanner 2, examples of the maintenance required state include a document jam and opening of the DF unit 11. More specifically, the maintenance required state refers to any state in which the user cannot obtain a desired job result without performing maintenance, and the maintenance required state is not limited to the above examples. At the timing 813, the CPU 13 stores the factor that has required maintenance in the SRAM 32, which is a nonvolatile memory, illustrated in illustrated FIG. 1. For example, according to the present exemplary embodiment, the CPU 13 stores information indicating that a sheet jam has occurred in the printer 4. At a timing 820, the controller 3 instructs the LCD touch panel 600 of the operation unit 8 to display the maintenance screen as illustrated in FIG. 3.

A timing 814 indicates a timing of shifting to the sleep state. Examples of a trigger of shifting to the sleep state include a timing of when the user presses the power saving key 610 illustrated in FIGS. 1 and 2 or a case where the RTC 34 calls a sleep shifting time that is set in advance. At the timing 814 of shifting to the sleep state, the controller 3, the printer 4, and the scanner 2 each shift to the sleep state. More specifically, the CPU 13 instructs the power supply control unit 35 to turn off each of the power 25 to 28 using the corresponding switch units 21 to 24. The controller 3 then controls displaying of the maintenance screen displayed at the timing 820 to be ended.

A timing 815 indicates a timing of recovery from the sleep state. Examples of a trigger of recovery from the sleep state include a timing of when the user presses the power saving key 610 illustrated in FIGS. 1 and 2. At the timing 815, the power supply control unit 35 turns on the controller section power 25, so that the power is supplied to the controller 3 and the controller 3 is activated. When activated, the controller 3 reads the factor that has required maintenance from the SRAM 32 and determines which engine needs to be recovered. For example, since the printer 4 is the factor according to the present exemplary embodiment, the controller 3 issues an activation request to the printer 4. More specifically, the CPU 13 instructs the power supply control unit 35 to turn on the printer section power 28 using the switch unit 22, and the printer 4 is then activated. On the other hand, for example, since the scanner 2 is not the factor that has required maintenance, the scanner 2 is not recovered from the sleep state.

After the activation of the printer 4, at a timing 822, the controller 3 queries the printer 4 about the factor that has required maintenance. The printer 4 responds to the query by notifying the controller 3 of the factor that has required maintenance, for example, a sheet jam. The timing in which the controller 3 detects the notification is a timing 816 in which the maintenance required state is detected. From the timing 816, the controller 3 controls the LCD touch panel 600 of the operation unit 8 to display the maintenance screen as illustrated in FIG. 3.

The maintenance screen continues to be displayed until the image forming apparatus 1 recovers from the maintenance required state, which is a timing 817. Examples of operations for recovery from the maintenance required state include, in a case where the maintenance required state is due to a sheet jam, the user removes the sheet jam. In a case where the maintenance required state is due to absence of toner, the user replenishes toner. After recovering from the maintenance required state, the image forming apparatus 1 does not need to maintain the engines activated. Thus, with the recovering from the maintenance required state as a trigger, the controller 3 instructs the printer 4 to shift to the sleep state. The printer 4 then shifts to the sleep state. A timing 818 indicates that it is the timing for shifting to the sleep state, again. At the timing 818, shifting to the sleep state is performed in the same way as the above described timing 814.

FIG. 5 is a flowchart illustrating an operation of the image forming apparatus 1. Each process illustrated in the flowchart is realized in such a manner that the CPU 13 executes a computer-readable program stored in the HDD 14.

An operation of the controller 3 in a case where the image forming apparatus 1 becomes in the maintenance required state and shifting to the sleep state is performed will be described with reference to FIG. 5A.

Figure 5A:
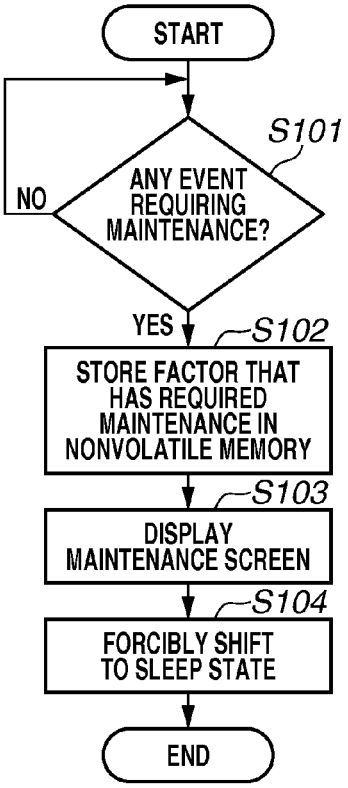
FIGS. 5A and 5B are flowcharts each illustrating an operation of the image forming apparatus.

FIG. 5A is a flowchart illustrating an operation example of the controller 3 in a case where the image forming apparatus 1 becomes in the maintenance required state and shifts to the sleep state.

In step S101, the CPU 13 monitors whether an event requiring maintenance occurs. In a case where the CPU 13 determines that there is no event requiring maintenance (NO in step S101), the CPU 13 continues monitoring in step S101. However, in case where the CPU 13 determines that the event requiring maintenance occurs (YES in step S101), the processing proceeds to step S102. Such an operation corresponds to the timing 813 according to the example illustrated in FIG. 4.

In step S102, the CPU 13 stores the factor that causes the maintenance required state, for example, the sheet jam in the printer 4 according to the present exemplary embodiment, in the SRAM 32 which is a nonvolatile memory illustrated in FIG. 1.

In step S103, as shown in the timing 820 illustrated in FIG. 4, the CPU 13 controls the LCD touch panel 600 of the operation unit 8 to display the maintenance screen as illustrated in FIG. 3.

In step S104, as shown in the timing 814 illustrated in FIG. 4, the CPU 13 forcibly performs shifting to the sleep state. Examples of a trigger of shifting to the sleep state include a timing of when the user presses the power saving key 610 illustrated in FIGS. 1 and 2 or a case where the RTC 34 calls a sleep shifting time that is set in advance. At the timing 814 of shifting to the sleep state, the controller 3, the printer 4, and the scanner 2 each shift to the sleep state.

Figure 5B:
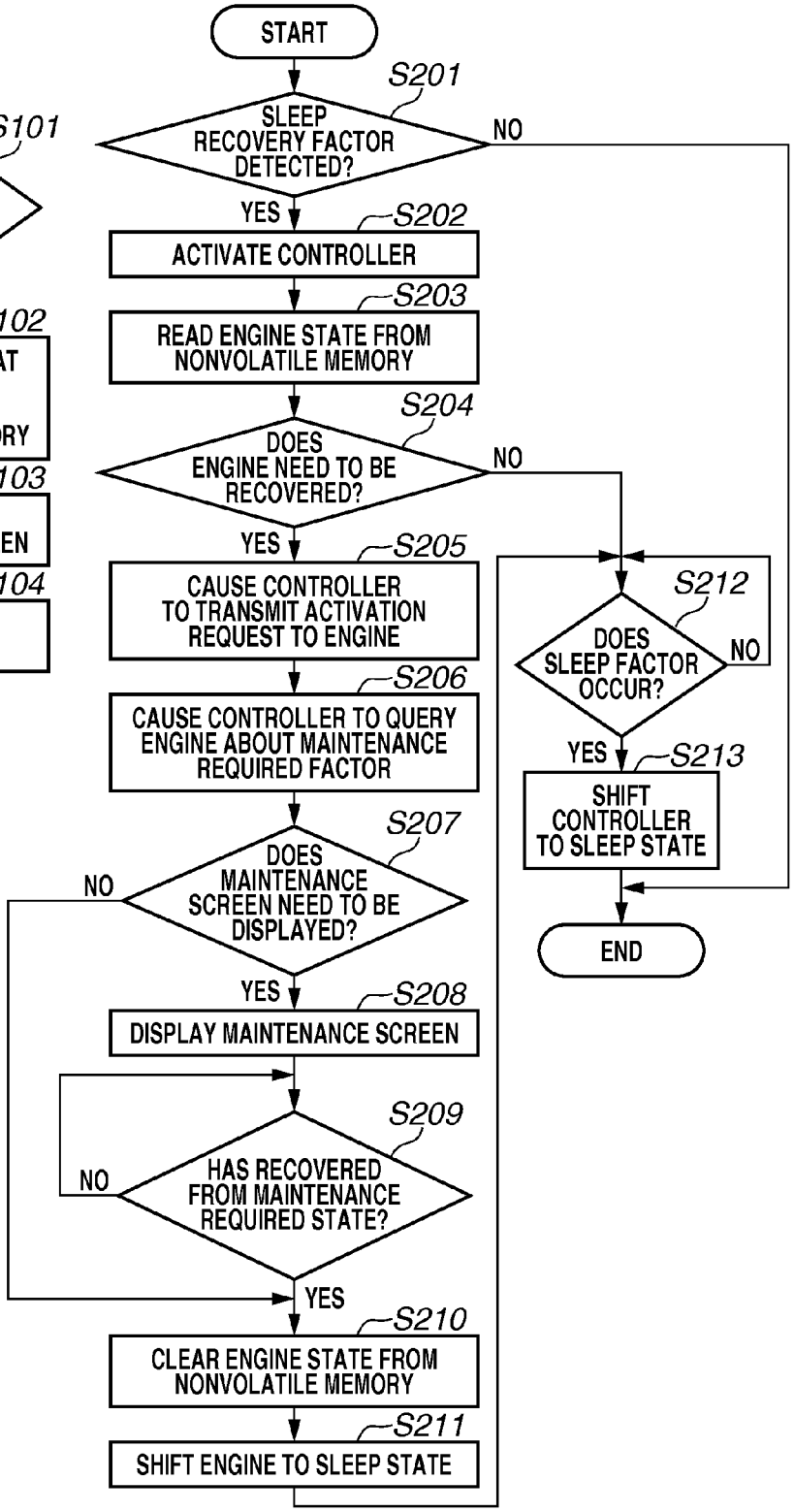

With reference to FIG. 5B, an operation of the controller 3 in a case where the image forming apparatus 1 recovers from the sleep state will be described.

FIG. 5B is a flowchart illustrating an operation of the controller 3 in a case where the image forming apparatus 1 recovers from the sleep state.

In step S201, in a case where the CPU 13 detects a sleep recovery factor (YES in step S201), the power supply control unit 35 causes the controller section power 25 to turn on, and the controller 3 is supplied with the power. Then, in step S202, the controller 3 is activated. Such an operation becomes the timing 815 illustrated in FIG. 4 of recovery from the sleep state. Examples of the recovery factor include a timing of when the user presses the power saving key 610 illustrated in FIGS. 1 and 2.

After the activation of the controller 3, in step S203, the CPU 13 reads the factor that has required maintenance from the SRAM 32. In step S204, the CPU 13 determines whether to recover an engine from the sleep state. In a case where the CPU 13 determines not to recover any engine from the sleep state (NO in step S204), the operation proceeds to step S212.

On the other hand, in a case where the CPU 13 determines to recover an engine from the sleep state (YES in step S204), the processing proceeds to step S205. In step S205, the CPU 13 transmits an activation request to the engine corresponding to the maintenance required factor read from the SRAM 32 in step S203. For example, according to the present exemplary embodiment, since the printer 4 is the factor, the CPU 13 transmits the activation request to the printer 4. More specifically, the CPU 13 instructs the power supply control unit 35 to turn on the printer section power 28 using the switch unit 22 so as to perform control to activate the printer 4 by supplying power. On the other hand, for example, since the scanner 2 is not the maintenance required factor, the CPU 13 does not cause the scanner 2 to recover from the sleep state in this step.

In step S206, the CPU 13 queries the engine (the printer 4 according to the present exemplary embodiment) about the maintenance required factor. The engine (the printer 4) responds to the query by notifying the controller 3 of information about the maintenance required factor, for example, a sheet jam. In such a procedure, the controller 3 acquires information about a maintenance required factor from a unit corresponding to the maintenance required factor.

In step S207, the CPU 13 determines whether the maintenance screen needs to be displayed. In a case where the CPU 13 determines that the maintenance screen does not need to be displayed (NO in step S207), the processing proceeds to step S210. In step S210, the CPU 13 clears the maintenance required factor from the SRAM 32 and the processing proceeds to step S211. In step S211, the CPU 13 shifts the engine (the printer 4 according to the present exemplary embodiment) to the sleep state.

In a case where the CPU 13 determines that the maintenance screen needs to be displayed (YES in step S207), the processing proceeds to step S208. In step S208, the CPU 13 controls the LCD touch panel 600 of the operation unit 8 to display the maintenance screen as illustrated in FIG. 3.

In step S209, the CPU 13 determines whether the image forming apparatus 1 has recovered from the maintenance required state. In a case where the CPU 13 determines that the image forming apparatus 1 has not recovered from the maintenance required state (NO in step S209), the CPU 13 waits until the image forming apparatus 1 recovers from the maintenance required state. In a case where the CPU 13 determines that the image forming apparatus 1 recovers from the maintenance required state (YES in step S209), the processing proceeds to step S210. In step S210, the CPU 13 clears the maintenance required factor from the SRAM 32 and the processing proceeds to step S211. In step S211, the CPU 13 shifts the engine (the printer 4 according to the present exemplary embodiment) to the sleep state. More specifically, the CPU 13 instructs the power supply control unit 35 to turn off the printer section power 28 using the switch unit 22 so as to control the printer 4 to shift to the sleep state by blocking power supplied to the printer 4.

In step S212, the CPU 13 determines whether a sleep factor occurs. In a case where the CPU 13 determines that a sleep factor does not occur (NO in step S212), the CPU 13 waits until a sleep factor occurs. On the other hand, in a case where the CPU 13 determines that a sleep factor occurs (YES in step S212), the processing proceeds to step S213. In step S213, the CPU 13 shifts the controller 3 to the sleep state.

For example at the timing 818 illustrated in FIG. 4, the CPU 13 shifts the controller 3 to the sleep state. Examples of a trigger of shifting to the sleep state include, as similar in step S104 illustrated in FIG. 5A, a timing of when the user presses the power saving key 610 illustrated in FIGS. 1 and 2 or a case where the RTC 34 calls a sleep shifting time that is set in advance.

In step S209, in a case where a sleep factor occurs while the CPU 13 is waiting for the image forming apparatus 1 to recover from the maintenance required state, the CPU 13 forcibly performs shifting to the sleep state, as similar in step S104 in FIG. 5A.

As described above, according to the present exemplary embodiment, even in the maintenance required state, the image forming apparatus 1 is forcibly shifted to the sleep state, which is effective in terms of power saving. Further, even in a case where the image forming apparatus 1 in the maintenance required state is forcibly shifted to the sleep state, the maintenance required factor is managed, a necessary engine is activated according to the maintenance required factor after the image forming apparatus 1 recovers from the sleep state, and the maintenance required state is displayed by the operation unit 8, which is therefore effective in usability and maintainability. Furthermore, since power is supplied to only a necessary engine, but not to any other unnecessary engines, the image forming apparatus 1 according to the present exemplary embodiment can achieve power saving while maintaining usability and maintainability (without deteriorating usability and maintainability), which is also beneficial. Accordingly, the image forming apparatus can achieve power saving, maintainability, usability at the same time. Therefore, the image forming apparatus 1 according to the present exemplary embodiment can achieve power saving together with prompt recovery in an ad hoc manner from a maintenance required state that occurs.

The configurations and contents of various data are not limited to the above description. Depending on the intended use or purpose, various configurations or contents may be used.

While an exemplary embodiment has thus been described, additional exemplary embodiments may be applied to a system including a plurality of devices or to an apparatus including a single device. In addition, any of the above exemplary embodiments may arbitrarily be combined.

According to the present exemplary embodiment, the image forming apparatus can achieve power saving without deteriorating the usability and the maintainability.

Additional embodiments can also be realized by a computer of a system or apparatus that reads out and executes computer executable instructions recorded on a storage medium (e.g., computer-readable storage medium) to perform the functions of one or more of the above-described embodiment(s), and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2013-259998 filed Dec. 17, 2013, which is hereby incorporated by reference herein in its entirety.

What is claimed is:

1. An image forming apparatus comprising:

a plurality of units configured to be controlled by a control unit;

a storage unit configured to store information indicating a unit requiring maintenance; and a power supply unit configured to stop supplying power to the plurality of units in a case where a condition for shifting the image forming apparatus to a power saving state is satisfied, wherein the power supply unit is configured to supply power to the unit requiring maintenance indicated by the information stored in the storage unit in a case where a condition for shifting the image forming apparatus to a standby state is satisfied.

2. The image forming apparatus according to claim 1, wherein the power supply unit is configured to stop power supplied to the unit requiring maintenance indicated by the information stored in the storage unit in a case where the maintenance of the unit requiring maintenance becomes unnecessary.

3. The image forming apparatus according to claim 1, wherein, in a case where the condition for shifting the image forming apparatus to the standby state is satisfied, the power supply unit not supply power to the plurality of units if the information indicating the unit requiring maintenance is not stored in the storage unit.

4. The image forming apparatus according to claim 1, wherein the plurality of units are a printer and a scanner.

5. The image forming apparatus according to claim 4, wherein the unit requiring maintenance is a printer in which a sheet jam occurs or is a scanner in which a document jam occurs.

6. The image forming apparatus according to claim 1, wherein, in a case where the condition for shifting the image forming apparatus to a standby state is satisfied, the power supply unit is configured to not supply power to units of the plurality of units that are not the unit requiring maintenance indicated by the information.

7. A control method of an image forming apparatus, the control method comprising:

storing information indicating a unit requiring maintenance of a plurality of units of an image forming apparatus that are configured to be controlled by a control unit;

stopping a supply of power to the plurality of units in a case where a condition for shifting the image forming apparatus to a power saving state is satisfied; and supplying power to the unit requiring maintenance indicated by the information in a case where a condition for shifting the image forming apparatus to a standby state is satisfied.

8. A non-transitory computer-readable storage medium storing computer executable instructions that causes a computer to execute a control method of an image forming apparatus, the control method comprising:

storing information indicating a unit requiring maintenance of a plurality of units of an image forming apparatus that are configured to be controlled by a control unit;

stopping a supply of power to the plurality of units in a case where a condition for shifting the image forming apparatus to a power saving state is satisfied; and supplying power to the unit requiring maintenance indicated by the information in a case where a condition for shifting the image forming apparatus to a standby state is satisfied.

9. An image forming apparatus comprising:

an image forming unit configured to form an image on a sheet;

a control unit configured to control the image forming unit;

a storage unit configured to store error information based on occurrence of an error in the image forming unit;

a shifting unit configured to, in a state where the error is present in the image forming unit, shift the image forming apparatus to a power saving state in which power supply to the image forming unit and to the control unit is stopped; and a power supply unit configured to, in a case where a condition for recovering the image forming apparatus from the power saving state is satisfied and the error information is stored in the storage unit, supply power to the control unit and to the image forming unit, and configured to, in a case where the condition for recovering the image forming apparatus from the power saving state is satisfied and the error information is not stored in the storage unit, supply power to the control unit but not to the image forming unit.

10. The image forming apparatus according to claim 9, wherein the power supply unit supplies power to the image forming unit when the image forming apparatus is used.

11. The image forming apparatus according to claim 9, wherein the power supply unit supplies power to the image forming unit when a user operation to use the image forming unit is input.

12. The image forming apparatus according to claim 9, wherein the power supply unit supplies power to the image forming unit when a user operation to cause the image forming unit to start a printing operation is input.

13. The image forming apparatus according to claim 9, further comprising:

a reading unit configured to read an image of a document; and another storage unit configured to store error information based on occurrence of an error in the reading unit, wherein, in a state where the error is present in the reading unit, the shifting unit shifts the image forming apparatus to the power saving state in which power supply to the reading unit, the image forming unit, and the control unit is stopped, and wherein, in a case where a condition for recovering the image forming apparatus from the power saving state is satisfied and the error information is stored in the other storage unit, the power supply unit supplies power to the control unit and to the reading unit, and, in a case where the condition for recovering the image forming apparatus from the power saving state is satisfied and the error information is not stored in the other storage unit, the power supply unit supplies power to the control unit but not to the reading unit.

14. The image forming apparatus according to claim 9, wherein the image forming unit that is supplied with power based on the error information being stored in the storage unit transmits information about the error to the control unit in response to a request from the control unit.

15. The image forming apparatus according to claim 14, further comprising a display unit configured to display the information about the error based on the control unit having received the information about the error.

16. The image forming apparatus according to claim 14, wherein the power supply unit stops power supply to the image forming unit according to the control unit having received information about the error from the image forming unit.

17. The image forming apparatus according to claim 9, wherein the error is at least one of a sheet jam, absence of a sheet, absence of toner, absence of ink, absence of a staple, and a door left open.

18. The image forming apparatus according to claim 9, wherein the condition for recovering the image forming apparatus from the power saving state is that a user operates a button to recover the image forming apparatus from the power saving state.

19. The image forming apparatus according to claim 9, wherein the storage unit configured to store the error information is a nonvolatile memory.

20. The image forming apparatus according to claim 9, wherein the power saving state is S3 state of the Advanced Configuration and Power Interface (ACPI) standard.

21. The image forming apparatus according to claim 9, wherein the power saving state is a suspended state.

22. The image forming apparatus according to claim 9, further comprising a reading unit configured to read an image of a document, wherein the power supply unit supplies power to the image forming unit and to the reading unit when a copy job is executed, supplies power to the image forming unit but not to the reading unit when a print job is executed, and supplies power to the reading unit but not to the image forming unit when a storage job is executed.

23. The image forming apparatus according to claim 9, further comprising a light-emitting diode (LED) configured to emit light based on the occurrence of the error in the image forming unit.

24. The image forming apparatus according to claim 9, wherein the control unit that is supplied with power by the power supply unit accesses the storage unit, and determines whether power is to be supplied to the image forming unit based on the error information stored in the storage unit.

25. The image forming apparatus according to claim 9, wherein the control unit that is supplied with power by the power supply unit accesses the storage unit, and determines a unit to be supplied with power based on the error information stored in the storage unit.

* * * * *